United States Patent [19]

Hsu

[11] 4,334,980

[45] Jun. 15, 1982

[54] NON-PUFFING PETROLEUM COKE

[75] Inventor: Harry L. Hsu, Johnson City, Tenn.

[73] Assignee: Great Lakes Carbon Corporation, New York, N.Y.

[21] Appl. No.: 135,717

[22] Filed: Mar. 31, 1980

Related U.S. Application Data

[63] Continuation-in-part of Ser. No. 8,838, Feb. 2, 1979, abandoned.

[51] Int. Cl.[3] ..... C10G 9/14

[52] U.S. Cl. ..... 208/125; 201/20; 208/131

[58] Field of Search ..... 208/131, 125, 126; 201/20

[56] References Cited

U.S. PATENT DOCUMENTS

| | | | |
|---|---|---|---|
| 2,775,549 | 12/1956 | Shea, Jr. | 196/52 |
| 3,506,745 | 4/1970 | Suel et al. | 264/29 |
| 3,873,427 | 3/1975 | Long et al. | 201/20 |
| 4,043,898 | 8/1977 | Kegler | 208/131 |
| 4,140,623 | 2/1979 | Sooter et al. | 208/131 |

FOREIGN PATENT DOCUMENTS

| | | | |
|---|---|---|---|
| 733073 | 7/1955 | United Kingdom | 208/131 |

OTHER PUBLICATIONS

*Fundamentals of Paint, Varnish, and Lacquer Technology,* Singer, American Paint Journal Co., St. Louis, 1966, pp. 63–71.

*Kirk-Othmer Encyclopedia of Chemical Technology,* 2nd Ed., Interscience, New York, 1968, vol. 15, pp. 555, 517–520.

*The Solubility of Nonelectrolytes,* Hildebrand and Scott, Dover, New York, 1964, pp. 4–5, 26–27.

Mellor, *Inorganic and Theoretical Chemistry,* Longmans Green, London, 1947, vol. XIV, pp. 310, 381.

*Primary Examiner*—Delbert E. Gantz

*Assistant Examiner*—William Leader

*Attorney, Agent, or Firm*—Adrian J. Good

[57] ABSTRACT

Very fine particle size iron oxide or calcium fluoride is dispersed in a high sulfur petroleum coker feedstock before delayed coking to produce a needle coke with low CTE and negligible puffing on heating to the temperature of graphitization.

9 Claims, 1 Drawing Figure

NON-PUFFING PETROLEUM COKE

This application is a continuation-in-part of Ser. No. 8,838, filed Feb. 2, 1979, and now abandoned.

BACKGROUND OF THE INVENTION

Electrode grade graphite is manufactured from a commercial grade of coke having an acicular, anisotropic microstructure called needle coke, see U.S. Pat. No. 2,775,549 to Shea, Dec. 25, 1956, Cl. 201-42, made by delayed coking of certain petroleum residues under specific conditions of heat and pressure. To produce graphite from such coke, it is necessary to heat it to a temperature in the range of 2000°-3000° C., which has the dual function of supplying energy for the conversion of the carbon in the coke to the graphitic crystalline form and of volatilizing impurities. When carbon bodies made from such cokes are heated at temperatures in the vicinity of 1000°-2000° C., various sulfur-containing compounds decompose, attended by a rapid and irreversible expansion of the carbon body. This phenomenon is termed "puffing". During the production of graphite articles, particularly high performance graphite electrodes, puffing is extremely undesirable as it may destroy the structural integrity of the piece and render it marginal or useless for its intended purpose.

Puffing of a carbon article made from high sulfur cokes generally starts at about 1500° C., and may result in a volumetric expansion of as much as 25%. It is not simply an elastic expansion but should be characterized as an inelastic, irreversible expansion.

The generally accepted explanation of the puffing phenomenon is that in acicular needle cokes with a relatively large amount of sulfur, sulfur atoms are bonded to carbon atoms by covalent bonds, either in carbon ring structures or linking rings. These bonds are less stable at high temperatures than the carbon-to-carbon bonds. On heating, the carbon-sulfur bonds rupture, the sulfur is freed, then reacts with hydrogen to form hydrogen sulfide. The simultaneous rupture of these bonds and evolution of hydrogen sulfide and other sulfur containing materials causes the physical expansion called puffing.

Puffing has been avoided in the past by using coke made from petroleum residues low in sulfur content. This approach is of only limited utility at present since the principal petroleum crudes currently in use have high sulfur contents, and the cokes made from their residues will normally exhibit an undesirable degree of puffing.

Another approach to elimination or alleviation of the puffing problem in manufacture of graphite articles has been by the use of additives. These additives have usually been added during the mixing stage when various sizes and grades of coke particles are mixed, before being wetted with pitch, formed into the desired shape, baked at an intermediate temperature and graphitized at high temperatures. Additives have included primarily metal salts and oxides, as disclosed in British Pat. No. 733,073, Greenhalgh, July 6, 1955, Cl. 90 b; French Pat. No. 1,491,497, Gillot et al., Aug. 11, 1967, Cl. C 01 b; French Pat. No. 2,035,273, Continental Oil, Dec. 18, 1970, Cl. C 10 b 57; U.S. Pat. No. 3,642,962, Wallouch, Feb. 15, 1972, Cl. 201-17; U.S. Pat. No. 3,563,705, Grindstaff et al., Feb. 16, 1971, C. C 01 b 31/04, Cl. 423-375; U.S. Pat. No. 3,842,165, Grindstaff et al. Oct. 15, 1974, Cl. C 01 b 31/04, Cl. 264-29.1; and U.S. Pat. No. 3,338,993, Juel et al. Aug. 29, 1967, Cl. 106-56.

The patents above disclose the use of iron, sodium, chromium, nickel, cobalt, boron, aluminum, titanium, calcium, zirconium, manganese, magnesium, barium and strontium compounds as puffing inhibitors. Some compounds of this group are in general usage and of these a choice is naturally made based upon the effectiveness as a puffing inhibitor and upon other properties of the graphite article such as electrical resistivity, tensile strength, modulus of rupture, modulus of elasticity, coefficient of thermal expansion, and cost.

Of the above, French Pat. No. 1,491,497 discloses the use of chromium oxide at 0.2-5% in a mixture with coke and a binder as a catalyst, enabling graphitization to occur at temperatures in the range of 1200°-2000° C.

French Pat. No. 2,035,273 discloses a low sulfur coke produced by the addition of 0.3-5% of sodium carbonate to the coking stream mixture and subsequent hydrogenation of the coke at high temperature.

British Pat. No. 733,073 discloses the use of oxides of chromium, iron, copper, or nickel incorporated in the grinding stage of coke, mixed with pitch, shaped, baked at 1200° C., and graphitized at 2500°-2800° C.

U.S. Pat. No. 3,563,705 discloses the use of mixtures of iron or calcium compounds with small amounts of titanium or zirconium compounds as puffing inhibitors incorporated into the coke-binder mixture.

U.S. Pat. No. 3,338,993 discloses the use of calcium, magnesium, strontium, and barium fluorides as puffing inhibitors with raw or calcined coke and binder, mixed, shaped, baked and graphitized.

U.S. Pat. No. 3,642,962 discloses the use of 1-3% calcium cyanamid or calcium carbide as desulfurizing agents and puffing inhibitors, mixed with raw coke prior to calcining.

U.S. Pat. No. 3,873,427, Long, issued Mar. 25, 1975, Cl. 201-17, discloses the addition of metallic chloride and ferruginous material for desulfurization of coke.

U.S. Pat. No. 4,043,898, Kegler, issued Aug. 23, 1977, Cl. 208/50, discloses delayed coking of selected feedstocks to produce needle coke.

At present, the most common methods of the above are those using iron oxides mixed dry in the coke-pitch binder blend as puffing inhibitors. These are effective puffing inhibitors but must be used with caution, as their use tends to increase the coefficient of thermal expansion or CTE, of the finished product, to an undesirable level.

The coefficient of thermal expansion (CTE), which is conventionally expressed in in./in./°C. or cm./cm./°C., is also of vital importance in the production of graphite for certain applications. Electrodes for electric furnace melting of steel must have a low CTE to avoid excessive differential expansion at operating temperatures and the resultant spalling, which in turn causes excessive consumption of the electrode and cost in operation. Other applications requiring dimensional stability at high temperatures are well-known although of somewhat less economic importance.

In general, the addition of any foreign material to a graphitizing carbonaceous mix will have, in addition to its desired effect, such as puffing inhibition, the effect of increasing the CTE of the graphite body.

A needle coke is distinguished by its physical structure when microscopically examined, showing long needle-like acicular particles. Such cokes, to be suitable for manufacture of graphite electrodes to be used in ultra-high powered electric steel furnaces, should have a graphite CTE characteristic of less than $5\times10^{-7}$/°C. measured over the range of 0°-50° C. Needle cokes for lower powered electric steel furnaces may have a graphite CTE characteristic of as much as $7\times10^{-7}$/°C. over the 0°-50° C. range.

The cokes or blends of cokes must be thoroughly mixed with the puffing inhibitor to avoid the difficulties present in making uniform homogeneous blends and in thoroughly coating the particles, which are often as much as 7 mm. in diameter. Both of these difficulties can lead to non-uniform dispersion of the inhibitor and to puffing, even though there is sufficient inhibitor present in the total mix to prevent puffing. This non-uniformity is particularly troublesome when operating under the newer type of graphitization processes, which raise the temperature of the carbon bodies (i.e. electrodes) at a much higher rate than the older processes. The combination of high sulfur with high rate of temperature rise exacerbates the problem and requires undesirably slow heating rates to overcome puffing.

It should be emphasized that overcoming the puffing problem becomes increasingly more difficult in the larger graphite electrode sizes (above 20 in. ((51 cm.)) diam) because in such sizes, larger particles of coke are used. Since the puffing inhibitor only coats the surface of the particles, the coke surface area to inhibitor weight ratio decreases, for a given weight addition ratio, giving a higher concentration of inhibitor on the coke particle surfaces for the larger particle blends. Thus a large amount of the inhibitor is at relatively greater distance from the centers of the coke particles in the larger coke particle mixes as opposed to the smaller particle mixes used in smaller electrodes. Migration of the inhibitor into the centers of the large particles becomes progressively more difficult and less effective as the coke particles increase in size.

The puffing problem is further increased with the rate of graphitization of the carbon bodies. Optimum distribution of the inhibitor throughout the structure of the carbon body to be graphitized is essential as the degree of puffing for any coke particle blend is highly rate sensitive, being directly related to the rate of temperature increase during the graphitization cycle. Thus, the figures in certain of the examples given will show a much higher dynamic puffing at a 14° C./min. temperature rise than for a 5° C./min. rise.

The amount of puffing for any given coke-inhibitor blend could be expressed as a proportionality in the general form:

$$DP=K(S,P,\Delta T)/I$$

where

DP=dynamic puffing
S=sulfur content of coke
P=mean particle size
ΔT=rate of temperature increase
I=amount of inhibitor
K=proportionality factor Thus it may be seen that increases in sulfur content, particle size, and temperature rise will increase puffing, while an increase in the inhibitor level will decrease puffing.

SUMMARY OF THE INVENTION

A petroleum coker feedstock which would normally produce a puffing coke due to its high sulfur content is rendered non-puffing by the addition of an effective amount of puffing inhibitor to the feedstock as a fine particle size powder.

Puffing inhibitors such as iron oxide and/or calcium fluoride may be pre-dispersed in a high concentration in a small quantity of the feedstock (fresh feed or coker furnace feed), or in compatible material miscible with the feedstock, or dispersed in the total coker stream and added either batchwise to a batch type coker, continuously to the main stream in a delayed coker, or near the top of a delayed coker (as in the case of anti-foam additives) while the coker stream is admitted into the coker at or near the bottom of the unit.

The use of a fine particle size powder of 100% less than 5 micron diameter, predispersed in a portion of the feedstock, insures that the final product will be a homogeneous coke with puffing inhibitor uniformly distributed throughout.

A current of inert gas or steam bubbled slowly through the hydrocarbons in a batch type coker during the run aids in keeping the puffing inhibitor in suspension without significantly increasing the CTE of the finished product. In a commercial delayed coker this is not essential. For a description of delayed coking, see R. J. Diwoky, *Continuous Coking of Residuum by the Delayed Coking Process,* Refiner and Natural Gasoline Manufacturer, Vol. 17, No. 11, November 1938.

Iron oxide is formed when any of numerous iron bearing materials is calcined, including organometallic compounds and salts. Minerals such as magnetite ($Fe_3O_4$), limonite ($2Fe_2O_3.3H_2O$); and pyrites ($FeS_2$) and salts such as ferric sulfate and nitrate when roasted in air are converted to ferric oxide, and may be used to form the oxide.

The reactive species may be elemental iron, produced by reduction of the $Fe_2O_3$ by coke during graphitization.

Calcium fluoride is also highly effective as an inhibitor with slightly superior performance as compared to iron oxide. Mixtures of the two inhibitors have shown a synergistic result, being more effective than either of the two when used alone.

The addition of inhibitor in this manner to the feedstock to the coker produces a coke which is lower puffing and produces a graphite which has a lower CTE than from a coke conventionally inhibited by a dry mix.

The mode of operation of these puffing inhibitors is probably a scavenging reaction, sulfur reacting with the metallic ions to form the sulfides, then decomposing slowly at higher temperatures to give a controlled evolution of vaporized elemental sulfur.

In general the use of any of the additives listed above, when added to a coke particle-pitch binder mix, will lower the extent of puffing, but at the same time significantly increase the CTE, of the graphite bodies made from such cokes. I have found that the use of puffing inhibitor dispersed in the coker feedstock in appropriate amounts prior to coking gives an unexpected advantage in that it controls puffing of the coke while increasing the CTE only to a smaller degree (or in some instances not at all), when compared to the CTE of a graphite body in which the puffing has been eliminated by adding the same additive to the electrode mix by the conventional dry-mix practice.

CTE of the graphitized coke was determined by preparing small $\frac{5}{8}''\times5''$(1.6×12.7 cm.) electrodes by the procedure disclosed in U.S. Pat. No. 2,775,549, (except for calcination of the coke to 1250° C.), and measuring their elongation over the temperature range of 0° to 50° C.

DESCRIPTION OF THE DRAWING

The drawing is a schematic representation of an apparatus for carrying out the process of the invention.

Figure 1:
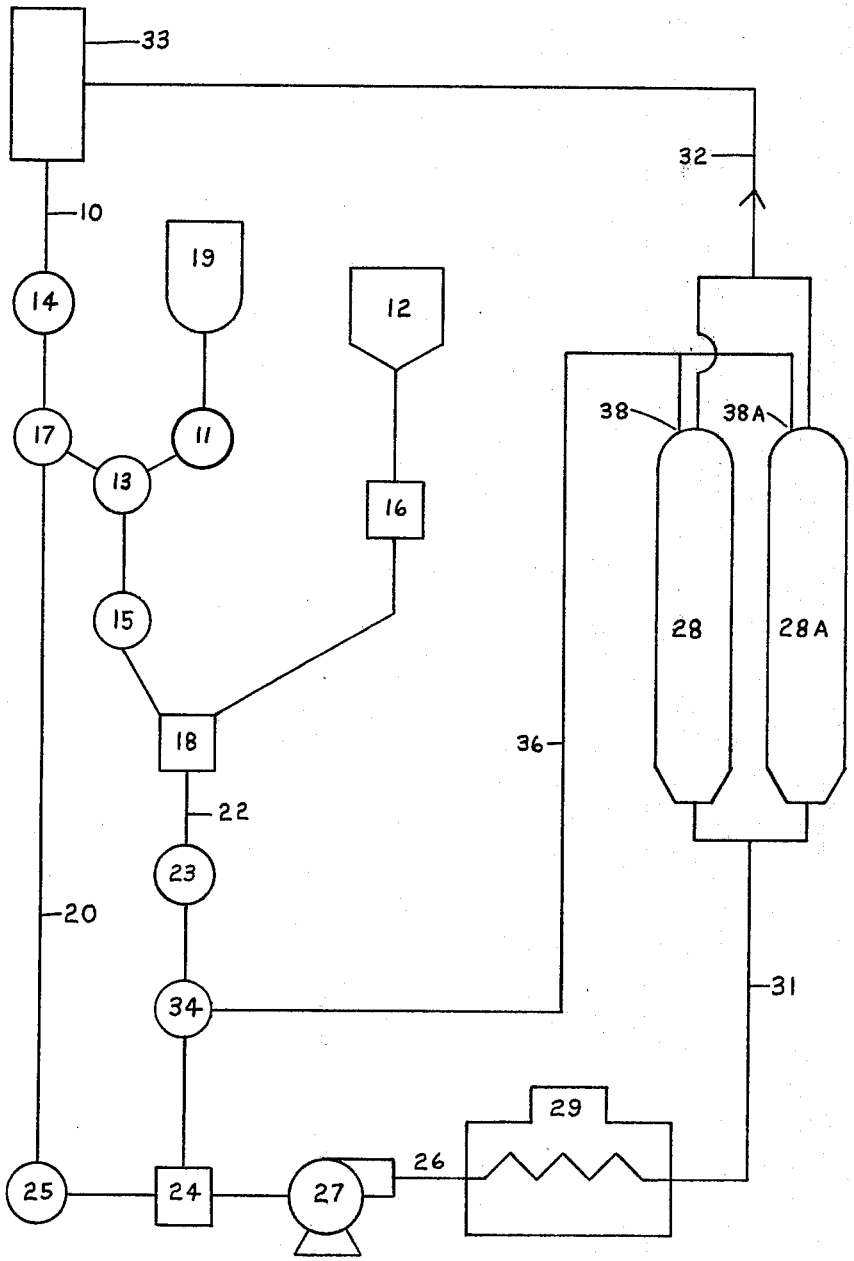
In FIG. 1 a decant oil, the fractionater tower bottoms from a catalytically cracked gas oil fraction, also termed slurry oil, or other equivalent hydrocarbon residue, is conveyed from the fractionater 33 through line 10 and meter 14 to diversion valve 17, where a portion of the feedstock is diverted through valve 13, and meter 15 to disperser 18. Simultaneously a portion of inhibitor 12 is weighed in scale 16 and conveyed to disperser 18 where it is dispersed in the feedstock to a specific concentration by weight. Alternately a compatible liquid and additives from supply 19 are metered through valve 11 to valve 13 and meter 15 to disperser 18. The inhibitor is dispersed and discharged through line 22 and meter 23 preferably to valve 34 and through line 36 to top inlets 38 and 38A of the coker drums. The inhibitor may also be fed through valve 34 to mixer 24 where it is mixed with the principal portion of the feedstock through pump 27, line 26, furnace 29 and line 31 to the bottom inlets of the coker drums 28 and 28A. The overheads are taken off through line 32 and sent to the fractionater 33.

In the above flowsheet, 18 is the disperser which may be any of several types of equipment well known in the art, preferably a high shear or colloid mill. Alternately, a sand or ball mill could be used.

In practice, a dispersion of approximately 5–50% by wt. of puffing inhibitor in the feedstock is used as a concentrate.

The puffing inhibitor dispersion and feedstock are metered in the correct proportions to give a concentration of approximately 0.05–0.5 wt. % puffing inhibitor in the feedstock.

At the operating temperature the viscosity of the feedstock is extremely low and some means is necessary to minimize settling and a concentration of the puffing inhibitor in the lower portion of the coker during batchwise coker operation. By the introduction of a small flow of inert gas bubbled up from the bottom of the coker drum the puffing inhibitor is maintained in a uniform suspension without significantly raising the CTE of the finished product or lowering the acicular crystal content of the coke. It is preferable to add the inhibitor at or near the top of the coke drum, through either the ports normally used to inject anti-foam or a special fitting.

The following are examples of specific methods of practicing the invention:

EXAMPLE 1

The micronized puffing inhibitors, calcium fluoride and iron oxide (having approximately the same particle size distribution) were individually mixed with samples of a fresh feed decant oil coker feedstock, at 0.1 wt. % level in a high speed blender for about 5 minutes. The mixtures were coked under identical conditions in 4 liter resin flasks.

In an insulated glass resin flask, an inert gas at the rate of 0.16 SCFH/kg (4.5 l/hr./kg.) mixture was bubbled up from the bottom of the coking pot to keep the inhibitor uniformly dispersed in feedstock. The following time-temperature cycle was used:

| Temperature | Elapsed Time | Rate ΔC.°/hr |
|---|---|---|
| Room to 350° C. | 3 hours | 110 |
| 350–450° C. | 4.5–5 hours | 20 |
| 450° C. | 16 hours | — |
| 450–530° C. | 4.0–4.5 hours | 20 |
| 530° C. | 1 hour | — |
| 530° C.-RT | Cool-down, power off | |

Dynamic puffing of the cokes was then determined in comparison with uninhibited samples, and with samples inhibited in the normal manner with dry-mixed iron oxide. The coke samples had 50%<200 mesh (79 mesh/cm.) particles and 100%<65 mesh (26 mesh/cm.) particles.

Puffing was measured by taking representative samples by the method of ASTM D346-35, crushing, mixing 100 g coke and 25 g pitch, and molding plugs at 12,500 psi (879 kg./cm.$^2$). The plugs were measured by micrometer and placed in a dilatometer. The temperature was raised to 1200° C. over a period of 50±10 min., then the test was run at a temperature increase of 5° or 12°–16° C./min. over the 1200°–2900° C. range, with measurements taken every five minutes. The reported DP is the maximum degree of elongation (or shrinkage) measured. All of the DP's below were at 14° C./min. rise except as noted.

| Inhibitor Added to Feedstock | Coke Yld. % | Coke Properties: Ash % | S % | CTE × $10^{-7}$/°C.** pph 0 | CTE × $10^{-7}$/°C.** $Fe_2O_3$* ½ | DP, % Δ L*** pph 0 | DP, % Δ L*** $Fe_2O_3$* ½ |
|---|---|---|---|---|---|---|---|
| 0 | 23.3 | 0.01 | 1.17 | 3.0 | — | +6.8 | — |
| 0 | 23.3 | 0.01 | 1.17 | — | 3.8 | — | +1.7 |
| 0.1% $CaF_2$ | 24.9 | 0.65 | 1.26 | 4.2 | — | +1.2 | — |
| 0.1% $Fe_2O_3$ | 23.0 | 0.50 | 1.22 | 4.1 | — | +1.6 | — |

*(Iron oxide dry-mixed into the coke)
**(Coefficient of Thermal Expansion over the range of 0°–50° C. × $10^{-7}$/°C., ⅜" × 5" (1.6 × 12.7 cm.) sample, 10 min. time)
***(Dynamic Puffing over the range of 1200°–2900° C.)

Of the two puffing inhibitors, the calcium fluoride was found to be the more effective. The addition of either inhibitor to the feedstock significantly decreased puffing of the resulting coke. The CTE of the resulting cokes was within the range (under $5\times10^{-7}$/°C.) considered necessary for a needle coke.

For less demanding applications, a CTE of the graphite body of as much as $7\times10^{-7}$/°C. may be acceptable, but for ultra high power electrodes for electric steel furnaces the upper limit is generally $5\times10^{-7}$/°C.

EXAMPLE 2

Another fresh feed sample was tested as in Example 1 using the inhibitors at a higher level of addition, with the following results:

| Inhibitor Added to Feedstock | Coke Properties: CTE $10^{-7}$/°C. | DP, % Δ L |
|---|---|---|
| 0 | 2.9 | 8.3 |
| $CaF_2$(0.2%) | 4.7 | 0.7 |
| $Fe_2O_3$(0.2%) | 5.1 | 0.7 |

Some feedstocks may well need and be beneficially treated with inhibitor additions of as much as 0.5%, resulting in a 2% ash level which is almost totally inhibitor in the final coke.

The examples above are not shown as limitations but merely samples from the wide variety of petroleum residues currently available.

I claim:

1. In a process for the manufacture of non-puffing needle coke having a graphite CTE characteristic of not higher than $7\times10^{-7}$/°C. over the range of 0° to 50° C. by delayed coking of petroleum feedstock having a level of sulfur content combined molecularly in components of said feedstock sufficiently high enough to contribute to an irreversible volumetric expansion on heating to a temperature of 1400° C. or higher, the improvement consisting of the addition of from 0.05 to 0.5% by wt. of puffing inhibitor selected from the group consisting of iron oxide and calcium fluoride or mixtures thereof to said feedstock prior to or during the coking of said feedstock in a delayed coker, thereby rendering said coke non-puffing.

2. The process of claim 1 wherein from 0.05 to 0.5% by wt. of puffing inhibitor is added to the feedstock in the form of a predispersed liquid concentrated dispersion of said puffing inhibitor in a liquid medium compatible with said feedstock.

3. The process of claim 1 wherein the puffing inhibitor used has a particle size diameter such that 100% of said particles are less than 5 microns and 70% are less than 2 microns.

4. The process of claim 1 wherein the puffing inhibitor is dispersed in a portion of the coker feedstock.

5. In a process for the manufacture of non-puffing coke suitable for conversion to graphite with a CTE characteristic of not higher than $5\times10^{-7}$/°C. over the range of 0° to 50° C. by delayed coking of petroleum feedstocks having sulfur molecularly combined in components of said feedstock in sufficient quantity to contribute to an irreversible volumetric expansion on heating to a temperature of 1400° C. or higher, the improvement consisting of selecting an effective amount of puffing inhibitor selected from the group consisting of iron oxide and calcium fluoride or mixtures thereof of particle size less than 5μ ($5\times10^{-6}$ m) to be added to said feedstock at a concentration by wt. of 0.05 to 0.5% of said feedstock, dispersing said puffing inhibitor in a portion of said feedstock or other compatible material to form a uniform dispersion of said puffing inhibitor; adding said dispersion to the principal portion of said feedstock at or near the top of a delayed coker drum and coking said feedstock in said delayed coker.

6. The process of claims 1 or 5 in which the puffing inhibitor is iron oxide.

7. The process of claims 1 or 5 in which the puffing inhibitor is calcium fluoride.

8. In a process for the manufacture of non-puffing needle coke having a graphite CTE characteristic not higher than $7\times10^{-7}$/°C. over the range of 0° to 50° C. suitable for conversion to electrode grade graphite by delayed coking of petroleum feedstock having a level of sulfur content in said feedstock sufficiently high enough to contribute to an irreversible volumetric expansion on heating said coke to a temperature of 1400° C. or higher, the improvement comprising the addition of an iron compound selected from the group consisting of ferric nitrate, ferric sulfate, pyrites, and limonite to said feedstock before or during coking said feedstock in a delayed coker, to render said coke non-puffing, said iron compound added in an amount effectively equivalent to 0.05% to 0.5% iron oxide by wt. of said feedstock.

9. The process of claims 1 or 8 wherein the puffing inhibitor is added to the feedstock during the coking process at or near the top of a delayed coker.

* * * * *